US005306047A

United States Patent [19]

Otake et al.

[11] Patent Number: 5,306,047

[45] Date of Patent: Apr. 26, 1994

[54] BOOKLET ALBUM OF PHOTOGRAPHS AND BINDING APPARATUS THEREFOR

[75] Inventors: Katsumi Otake; Yuhei Kishimura; Shuichi Nakajima, all of Tokyo, Japan

[73] Assignee: Fuji Photo Film Co., Ltd., Minami-ashigara, Japan

[21] Appl. No.: 897,640

[22] Filed: Jun. 12, 1992

[30] Foreign Application Priority Data

Jun. 14, 1991 [JP] Japan ..... 3-170629

[51] Int. Cl.[5] ..... B42D 1/00

[52] U.S. Cl. ..... 281/21.1; 412/37

[58] Field of Search ..... 412/36, 37, 9, 33; 281/21.1, 15.1

[56] References Cited

U.S. PATENT DOCUMENTS

| | | | |
|---|---|---|---|
| 3,437,506 | 4/1969 | Falberg | 412/36 |
| 3,616,074 | 10/1971 | Hoff et al. . | |
| 3,804,694 | 4/1974 | Blair . | |
| 5,011,187 | 4/1991 | Hunder et al. | 412/36 X |
| 5,052,872 | 10/1991 | Hunder et al. | 281/21.1 |
| 5,052,873 | 10/1991 | Parker et al. | 412/36 X |

FOREIGN PATENT DOCUMENTS

| | | |
|---|---|---|
| 1536488 | 1/1970 | Fed. Rep. of Germany . |
| 2027692 | 10/1970 | France . |
| 919854 | 2/1963 | United Kingdom . |

*Primary Examiner*—Mark Rosenbaum
*Assistant Examiner*—William Fridie, Jr.

[57] ABSTRACT

A booklet album is constructed by a booklet body consisting of a bundle of photographs sandwiched between front and rear cover sheets, and a narrow adhesive tape which is adhered to one side of the booklet body so as to form the back or spine cover of the booklet album. A photograph binding apparatus is provided with a pair of nipping members for nipping the booklet body, and a photograph receiving tray for supporting the lower end of the booklet body inserted between the nipping members. When pressing the adhesive tape onto the booklet body, the photograph receiving tray is retracted from the booklet body after the booklet body is tightly nipped by the nipping members, and instead, a stage supporting the adhesive tape is lifted toward the booklet body. The stage is as large as the adhesive tape, and has a plurality of ridges for inventively pressing the adhesive tape.

23 Claims, 9 Drawing Sheets

BOOKLET ALBUM OF PHOTOGRAPHS AND BINDING APPARATUS THEREFOR

BACKGROUND OF THE INVENTION

1. Field of the Invention

The present invention relates to a booklet album in which a plurality of photographs are directly bound as a booklet. The present invention also relates to a binding apparatus for making the booklet album.

2. Description of the Related Art

A photograph binding apparatus for making a booklet album by attaching one side of a bundle of photographs to a cover sheet, is known, for example from Japanese Laid-open Patent Application No. 2295796 (corresponding to U.S. Pat. No. 5,026,236). Such an apparatus is intended to make the storage and viewing of photographs efficient and convenient.

The cover sheet is made of cardboard or the like, and has an adhesive layer thereon. After a bundle of photographs are stuck to the adhesive layer, the cover sheet is bent in a channel shape to form a front cover portion, a back or spine cover portion, and a rear cover portion. The adhesive layer is applied on the rear surface of the back cover portion, i.e., the spine side.

The conventional photograph binding apparatus is provided with a pair of nipping plates disposed parallel to each other and extending vertically. A bundle of photographs are nipped between these nipping plates, and the lower end and one side of the bundle are abutted against straightening trays. A motor of a photograph end straightening mechanism is driven to vibrate the photographs to straighten the lower end and the one side of the bundle. Thereafter, the nipping plates are moved into a bonding position. Then, a bonding mechanism bonds the lower ends of the photographs to the adhesive layer of the cover sheet. The bonding mechanism has a press roller which is moved by a link mechanism. The press roller is protruded through a slot of the stage supporting the cover sheet and the bundle is moved lengthwise along the lower end of the bundle so as to press the adhesive layer onto the lower end of the bundle.

However, the wide cover sheets used for making the booklet albums are difficult to handle and require a large space for storage. Furthermore, it is necessary to provide a large stage for supporting the wide cover sheet and a large space for accommodating the photograph end straightening mechanism in the binding apparatus. As a result, the binding apparatus itself must be large.

The bonding mechanism of the known binding apparatus also needs a large space therefor, because the press roller must be moved along the lower ends of the photographs so as to gradually stick the adhesive layer of the cover sheet to the lower ends. Moreover, because the press roller presses the adhesive layer uniformly, the force applied to the adhesive layer is distributed, so that the pressure is reduced to result in insufficient or inefficient bonding.

Furthermore, because the thickness of the booklet album varies according to the number of photographs in the bundle, and the cover sheet is bent correspondingly, the adhesive layer may be too wide if there is a small number of photographs. Accordingly, the excess adhesive may adhere to the surfaces of the first and last photographs of the bundle when the cover sheet is bent. In order to prevent this problem, it is necessary to place a sheet of paper on either side of the bundle of the photographs.

SUMMARY OF THE INVENTION

In view of the foregoing, a primary object of the invention is to provide a booklet album which can be assembled by a small photograph binding apparatus.

Another object of the invention is to provide a booklet album in which any excessive adhesive does not adhere to the front and back surfaces of the photographs, thus eliminating the need for additional paper placed on the front or back of the photograph.

Still another object of the invention is to provide a photograph binding apparatus which is small and compact.

A further object of the invention is to provide a photograph binding apparatus which can press an adhesive tape onto one end of a bundle of photographs efficiently at a high pressure.

To achieve the above and other objects, the invention provides a booklet album in which a bundle of photographs is sandwiched between front and rear cover sheets, and an adhesive tape is stuck to one end of the bundle and the corresponding fringes of the front and rear cover sheets, so as to form the back or spine cover sheet of the booklet album.

According to a preferred embodiment, the adhesive tape used for binding the booklet body is constructed by a base strip including an adhesive portion on which an adhesive layer is applied, and a tab portion extending beyond the adhesive portion and bordered by a perforation line, and a peelable paper which is removably stuck to the adhesive layer.

According to another embodiment, the adhesive tape has a couple of non-adhesive tracks in an adhesive layer applied on the entire length of the base strip. The non-adhesive tracks extend parallel to each other in a longitudinal direction of the base strip, so as to enable the peelable paper to be mechanically removed.

A photograph binding apparatus of the invention is provided with a pair of nipping members for nipping a booklet body that includes a bundle of photographs as well as front and rear cover sheets disposed on the front and rear side of the bundle. A device for displacing the nipping members between an opened state and a nipping state is provided and a photograph receiving member supports the lower end of the booklet body inserted between the nipping members in the opened state. A transporting device retracts the photograph receiving member from the booklet body after the nipping members are set in the nipping state and a pressing device presses an adhesive tape onto the lower end of the booklet body by lifting a stage on which the adhesive tape is laid.

According to the invention, because a narrow adhesive tape is used to bind a booklet body, that is, a bundle of photographs is sandwiched between front and rear cover sheets, it is not necessary to provide a wide stage for supporting a wide cover sheet. Therefore, the photograph binding apparatus of the invention is compact. Furthermore, the adhesive tape is prevented from sticking to the front or back of the photographs, because it is adhered to the outside surface of the front and rear cover sheets. Also, the narrow adhesive tape can be stored conveniently.

The tab portion facilitates the removal of the peelable paper, and prevents the adhesive from adhering to finders or other mechanical parts when the peelable paper is removed.

Moreover, the use of an adhesive tape having non-adhesive tracks in the adhesive layer enables the peelable paper to be removed mechanically, for example, by a separation member with a fork or claws.

In the photograph binding apparatus of the invention, the stage for supporting the adhesive tape can have substantially the same width as the narrow adhesive tape, so that the size of the apparatus can be remarkably reduced as compared to conventional devices. Also, the invention does not require an electric driver, such as a motor. This also contributes to minimize the size and cost of the binding apparatus of the invention.

According to a preferred embodiment of the invention, a plurality of projections are provided on the stage for supporting the adhesive tape. The projections serve to concentrate the force applied to the adhesive tape, so that the adhesive tape is efficiently pressed onto the booklet body, and is reliably adhered thereto.

BRIEF DESCRIPTION OF THE DRAWINGS

The above and other objects and advantages of the present invention will become apparent from the following detailed description of the preferred embodiments when read in connection with the accompanying drawings, wherein like reference numerals designate like parts throughout several views, and wherein.

DETAILED DESCRIPTION OF THE PREFERRED EMBODIMENTS

Figure 1:
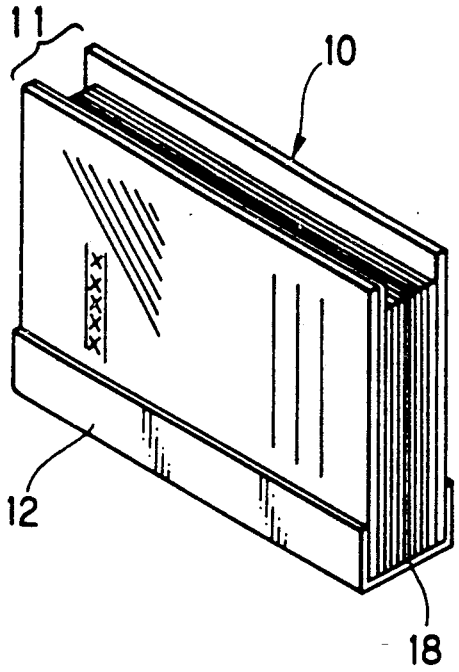
FIG. 1 is a perspective view showing a first embodiment of a booklet album according to the invention.
Figure 2:
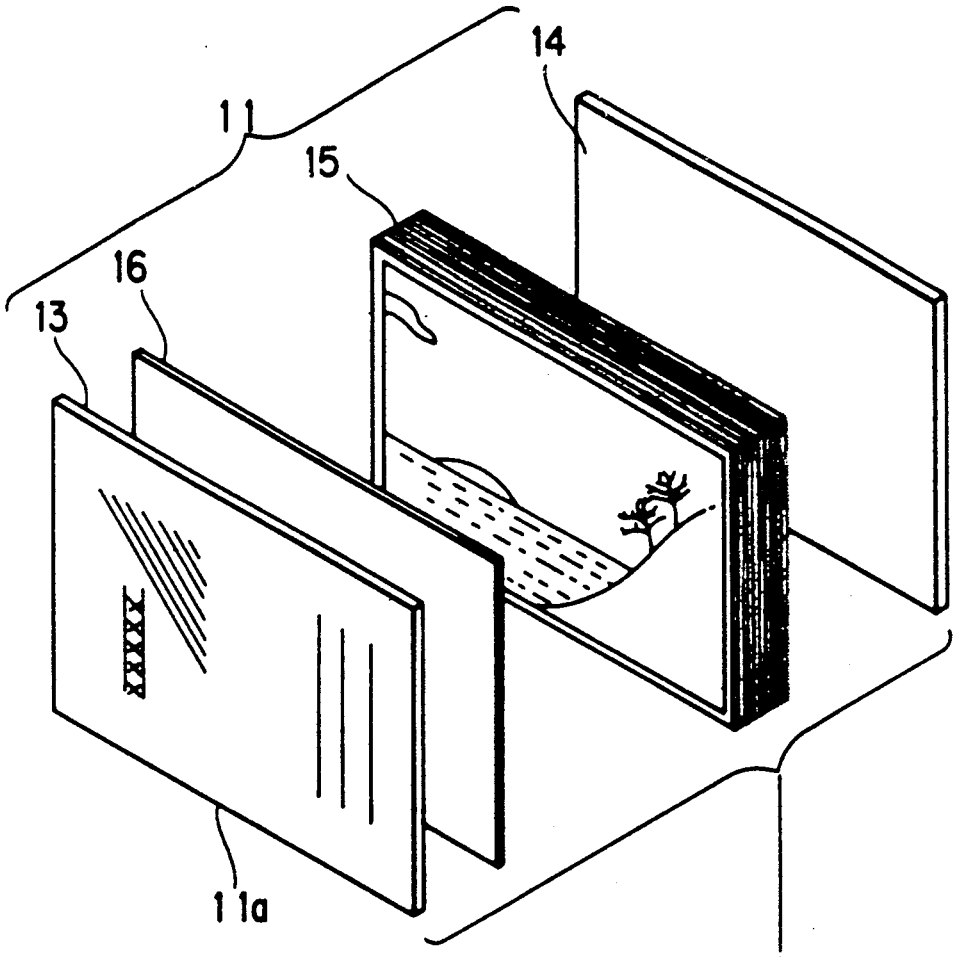
FIG. 2 and 2(A) is an exploded view of the first embodiment for explaining the manufacturing procedure therefor.
Figure 2A:
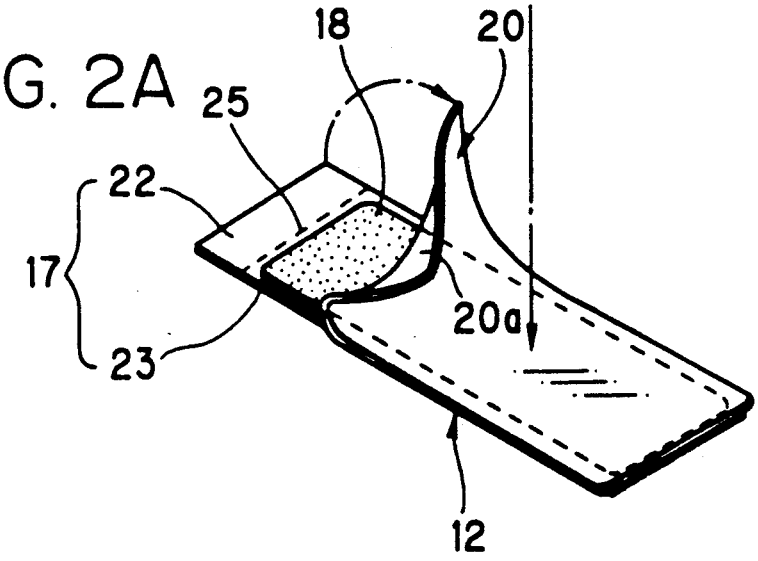

FIGS. 1 and 2 show a booklet album 10 according to a first embodiment of the invention. The booklet album 10 is formed of a booklet body 11 and an adhesive tape 12. The booklet body 11 consists of a front cover sheet 13, a rear cover sheet 14 and a bundle of photographs 15 piled on each other and sandwiched between the cover sheets 13 and 14. The cover sheet 13 and/or the cover sheet 14 may have data entry columns and decorative illustrations or the like printed on the surfaces thereof. A title, the date and the location of photographing, and other data may be entered in the columns.

Furthermore, at least a piece of memo paper 16 may be inserted between the front or rear side of the bundle of the photographs 15, on one hand, and the front or rear cover sheet 13 or 14, on the other hand, respectively.

The adhesive tape 12 is constituted by a base strip 17, an adhesive layer 18 and a peelable paper 20. The base strip 17 is made of paper or a plastic resin sheet thinner than the cover sheets 13 and 14, and has a non-adhesive tab portion 22. The tab portion 22 is for pinching the base strip 17 when removing the peelable paper 20 from the base strip 17. The base strip 17 also has an adhesive portion 23 on which the adhesive layer 18 is applied. A perforation line 25 is provided between the tab portion 22 and the adhesive portion 23, so as to allow removal of the tab portion 22 along the perforation line 25 when completing the process of making the booklet album 10. The size of the peelable paper 12 is equal to that of the base strip 17, and prevents the adhesive layer 18 from sticking unnecessarily.

The adhesive portion 23 is approximately equal in length to a spine side 11*a* of the booklet body 11, but is greater in width than the spine side 11*a*. Accordingly, the adhesive in the layer 18 will adhere to the outside surface of the cover sheets 13 and 14, when the booklet body 11 is stuck to the adhesive tape 12 on the spine side 11*a*, and the tape 12 is bent along the spine side edges of the front and rear cover sheets 13 and 14. The adhesive in the layer 18 has just enough adhesive strength to allow the photographs 15 to be pulled out of the album 10 individually, after the photographs 15 are stuck to the adhesive tape 12. In order to prevent the adhesive in layer 18 from oozing out of the adhesive tape 12, the application of the adhesive layer 18 is limited to an area receding about 1 mm from the fringes of the adhesive portion 23.

Because the photographs 15 are stuck to the adhesive tape 12 only at one edge thereof, it is possible to remove the photographs from the album, individually. The photographs 15 may be stuck to the adhesive tape 12 at any of the edges thereof. Also, it is preferable to provide a transparent pocket behind the front cover sheet for holding a corresponding negative film.

Any adhesive material composed of rubber, resin and elastomers may be used as the adhesive layer 18. The rubber may be SBR (styrene-butadiene rubber), natural rubber, or the like. The resin may be water-added rosin-glycerine ester. The elastomer may be styrene-butadiene copolymer. Such an adhesive having the above components is resistant to sea-water, is non-toxic and maintains its viscosity for a long period of time (more than ten years). Therefore, it is easy to page through the photographs bound as a booklet and also to remove the individual photographs from the booklet album 10 after binding, as well as to insert the photograph back into the booklet album 10.

Now, the steps of making the booklet album 10 will be described.

First, the peelable paper 20 is peeled off the base strip 17, while pinching the tab portion 22 of the base strip 17 and a portion 20*a* of the peelable paper 20 facing the tab portion 22. Because it does not have any adhesive thereon, the tab portion 22 facilitates the peeling of the peelable paper 20. Next, the booklet body 11 is, after the spine side 11*a* thereof has been straightened, pressed to the adhesive tape 12, such that the center of the spine side 11*a* is aligned with the center of the adhesive portion 23. Then, longitudinal side edges of the adhesive tape 12 are bent to be adhered to the outside surfaces of the cover sheets 13 and 14. Thereafter, the tab portion 22 is cut off along the perforation line 25, completing the construction of the booklet album 10.

A photograph binding apparatus according to a second embodiment of the present invention will be described with reference to FIGS. 3–7. The apparatus has a holding section 30 protruding upward, and a photograph receiving tray 31 disposed below the holding section 30, for supporting the spine side 11*a* of the booklet body 11 in a substantially horizontal fashion.

The holding section 30 consists of a stationary nipping plate 37 and a movable nipping member 38 which is moved horizontally toward and away from the stationary nipping plate 37. The stationary nipping plate 37 is secured to a top side of a stay plate 35 which extends from a right side plate 33 to a left side plate 34 of the apparatus. The movable nipping member 38 includes a fixed plate 40 and a pressing plate 41 (see FIG. 4). Springs 42 are mounted to the fixed plate 40 and urge the pressing plate 41 toward the stationary nipping plate 37.

Rubber sheets 44 are cemented to the facing surfaces of the stationary nipping plate 37 and the pressing plate 41, so as to protect the booklet body 11 from being damaged when the booklet body 11 is nipped between these plates 37 and 41. The rubber sheets 44 extend beyond the bottom edges of the plates 37 and 41, so as to prevent the adhesive layer 18 of the adhesive tape 12 from sticking to the bottom edges of the holding section 30 after being bound by the adhesive tape 12.

Figure 4:
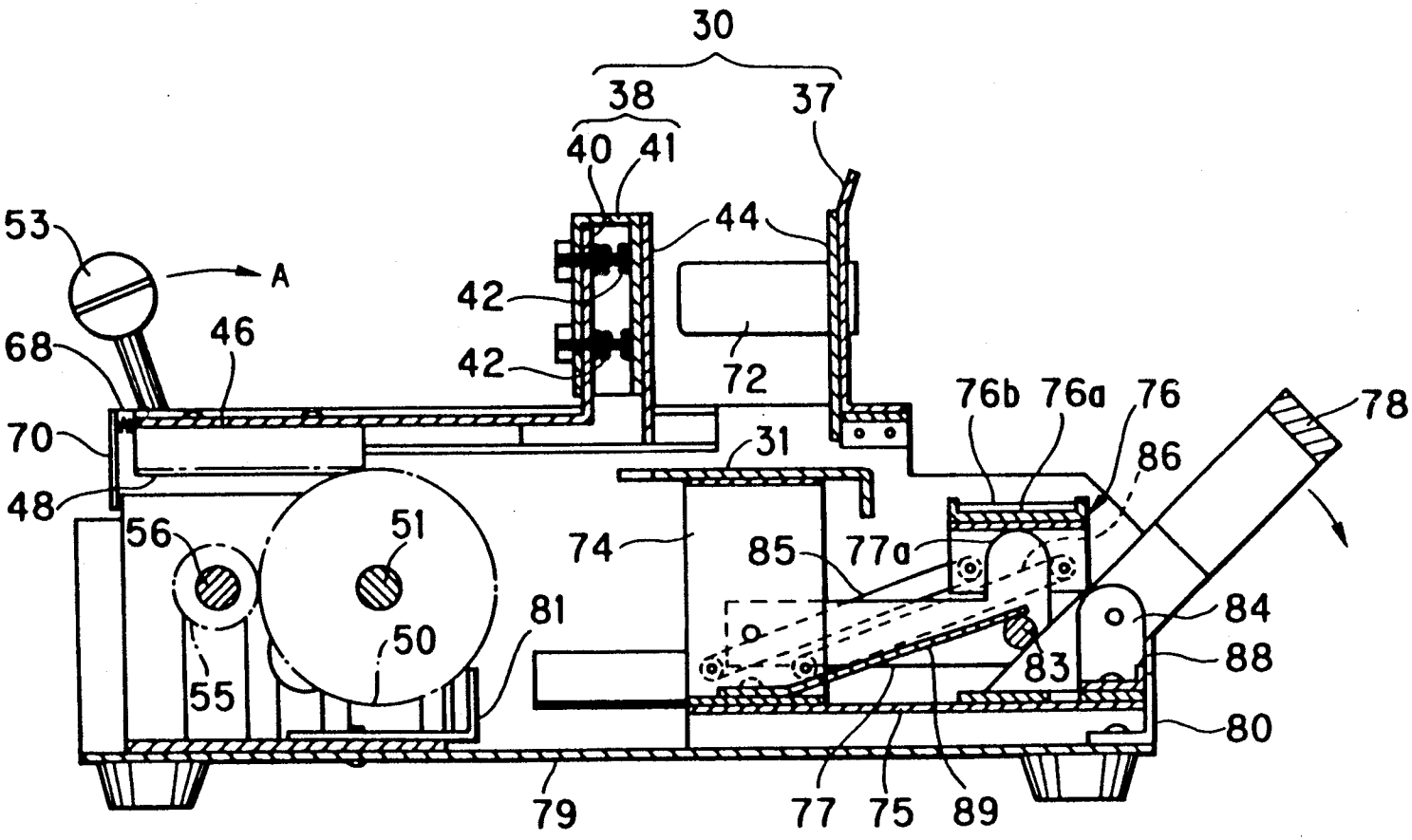
FIG. 4 is a sectional view of the second embodiment with its holding portion opened.
Figure 5:
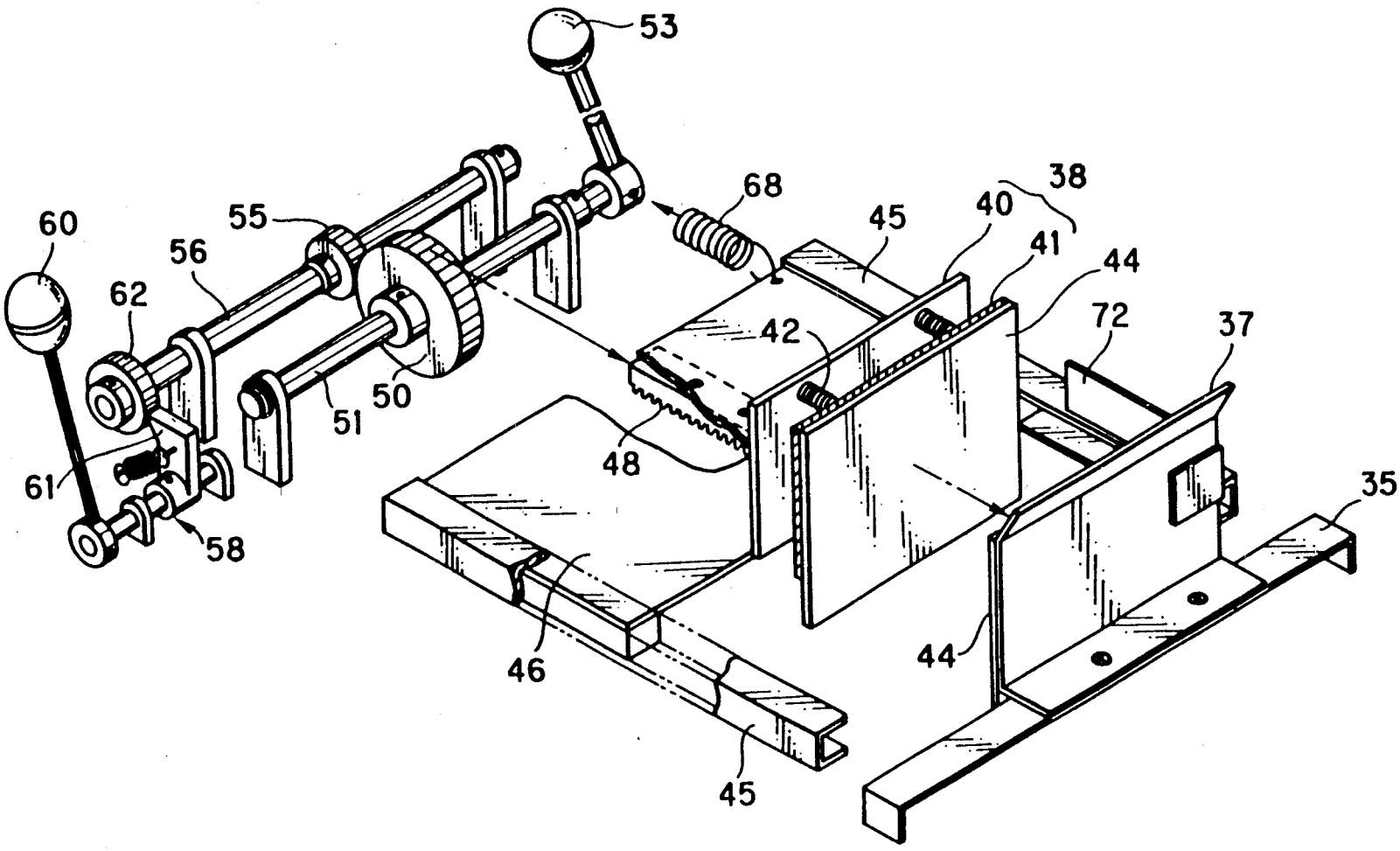
FIG. 5 is an exploded perspective view of the holding portion of the second embodiment and a mechanism for opening and closing the holding portion.

The supporting plate 40 is secured to an upper sliding plate 46 which is slid horizontally along a pair of guide channels 45 which are secured to the right and left side plates 33 and 34. As shown in FIGS. 4 and 5, a rack 48 is secured to the inside surface of the sliding plate 46 on a rear side portion thereof, that is, a portion apart from the fixed plate 40. The rack meshes with a gear 50, to which a lever 53 is coupled through an axle 51, such that the upper sliding plate 46 is slid forward and rearward by operation of the lever 53.

The gear 50 meshes with a gear 55, which is disposed behind the gear 50 and secured to an axle 56. A ratchet mechanism 58 is disposed on the left end portion of the axle 56. The ratchet mechanism 58 allows the lever 53 to be pulled forward, that is, be rotated in a clockwise direction as shown by an arrow in FIG. 4, and prevents the lever 53 from being rotated reversely. A ratchet release lever 60 is provided on the outer surface of the left side plate 34 at a rear side portion thereof. When the ratchet release lever 60 is pulled forward, a pawl 61 is disengaged from a ratchet wheel 62, thereby releasing the ratchet mechanism 58 and allowing the lever 53 to be rotated in a counter clockwise direction.

The upper sliding plate 46 is urged by a spring 68 to move the movable nipping member 38 away from the stationary nipping plate 31, so that the upper sliding plate 46 automatically moves rearward after the ratchet release lever 60 is pulled to release the ratchet mechanism 58, and stops when the rear end of the plate 46 strikes against a stopper 70. As a result, the holding section 40 is opened, allowing the insertion of the booklet body 11 between the nipping plate 37 and the nipping member 38. A positioning plate 72 is disposed on the right side of the nipping plate 37 and the nipping member 38, for defining the position of the right side of the booklet body 11 held in the holding section 30.

Figure 3:
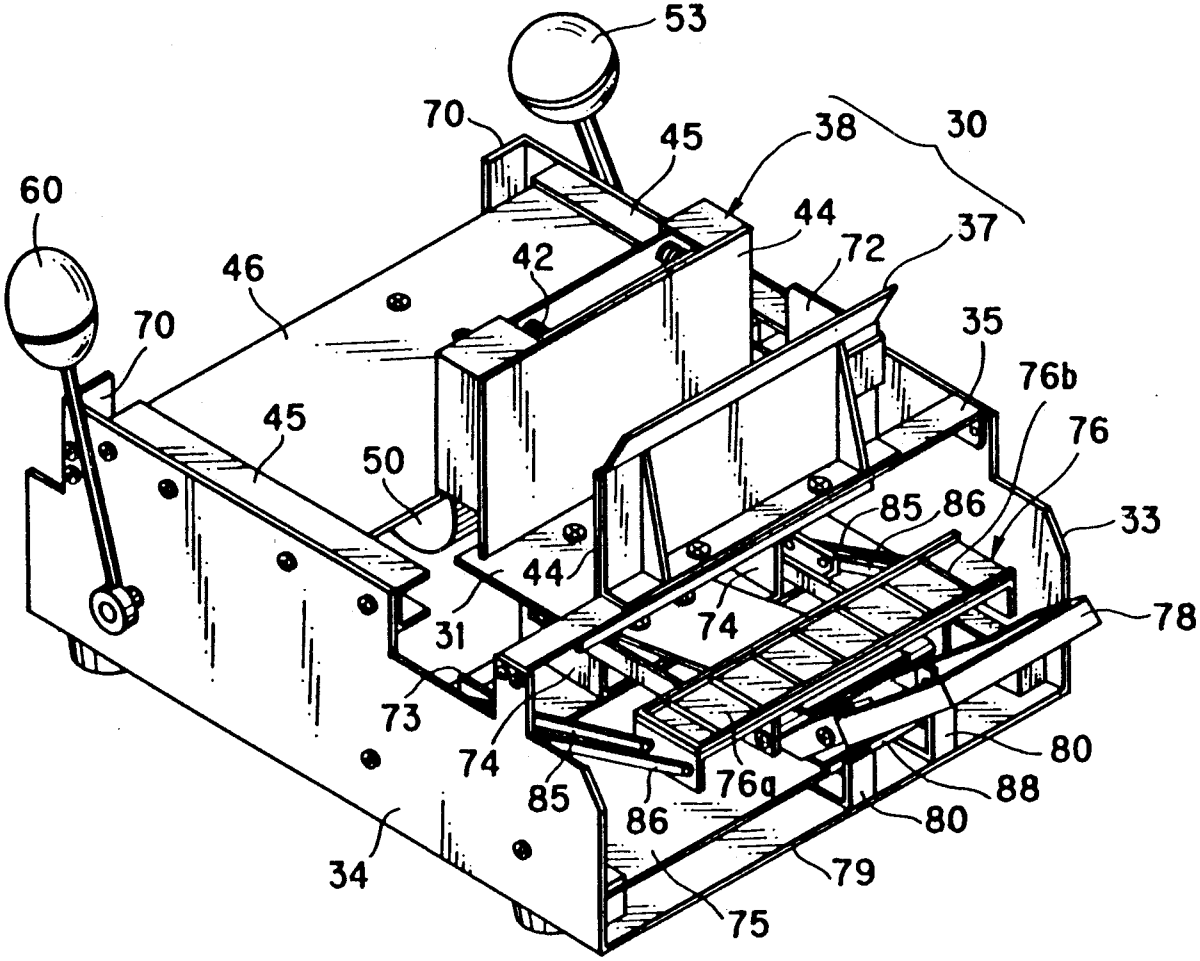
FIG. 3 is a perspective view showing a photograph binding apparatus according to a second embodiment of the invention.

As shown in FIGS. 3 and 4, the photograph receiving tray 31 is secured to a channel-shaped supporting plate 74 which is fixedly disposed in a channel-shaped bracket 73. The supporting plate 74 and the bracket 73 are secured to a lower sliding plate 75 and extend parallel to the stay plate 35. The lower sliding plate 75, on which a stage 76 for laying the adhesive tape thereon, a couple of lifting plates 77, a handle 78, and other members are mounted, is slidable between stoppers 80 and 81 which are secured to a base plate 79. The stage 76 is slightly larger in size than the adhesive tape 12, and is fixedly supported by a flat bench 82.

Figure 6:
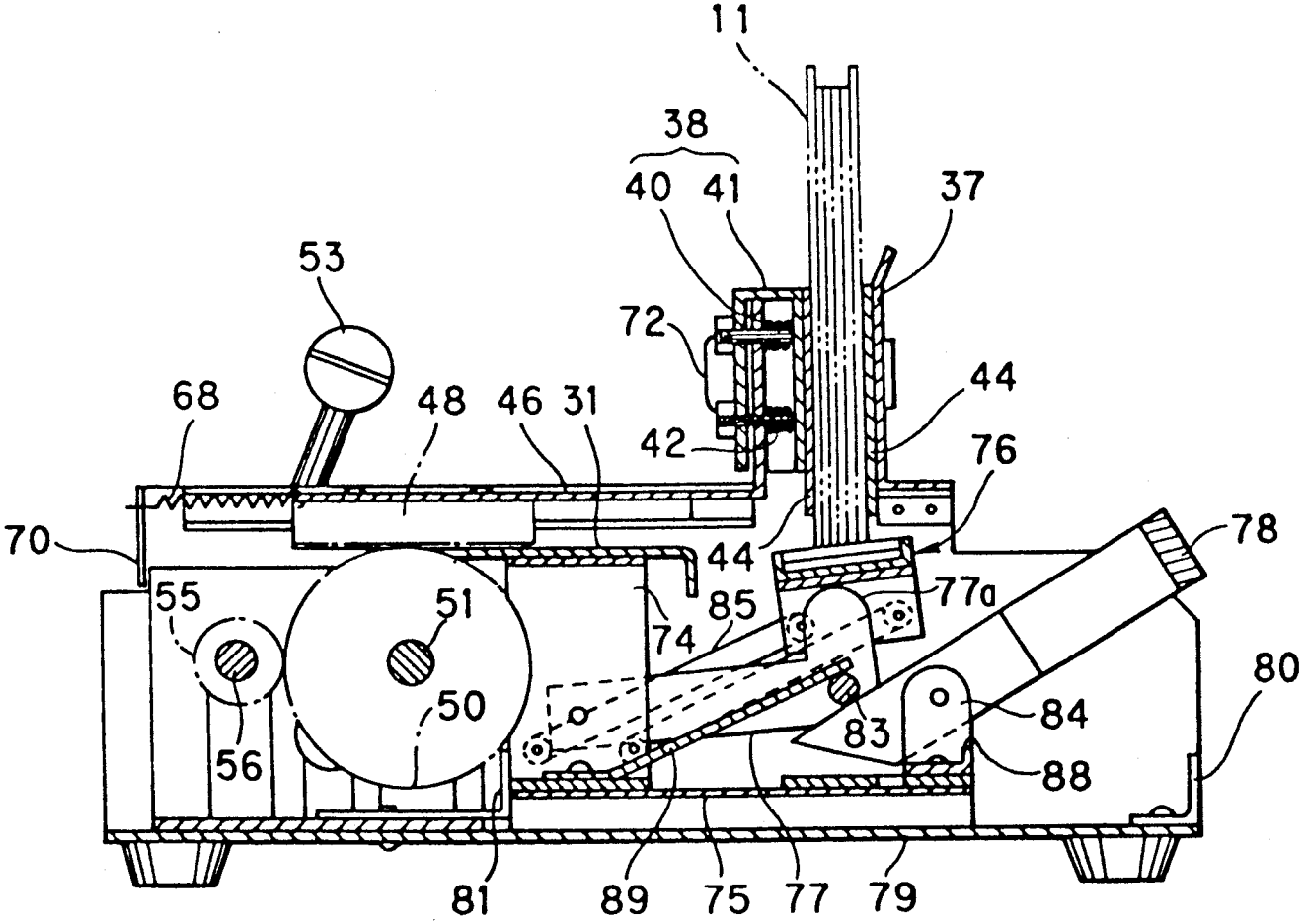
FIG. 6 is a sectional view of the second embodiment with its holding portion closed.

When the lower sliding plate 75 contacts the stopper 80, as shown in FIG. 4, the photograph receiving tray 31 is positioned below the holding section 30. When the lower sliding plate 75 contacts the stopper 81, as shown in FIG. 6, the photograph receiving tray 31 is retracted from the bottom of the holding section 30. Instead, the stage 76 is placed below the holding section 30.

The lifting plates 77 are L-shaped. One end of each lifting plate 77 is pivotally mounted to the outside surface of the supporting plate 74, whereas the other end, rounded at end portion 77*a*, contacts the bottom of the stage 76. A stay bar 83 extending transversely between the lifting plates 77, is secured to the respective angle portions of the L-shaped lifting plates 77. The stay bar 83 rides on the legs of the horseshoe-shaped handle 78. Because the handle 78 is pivotally mounted to a couple of supporting members 84 at portions near the ends of the legs of the handle 78, the lifting plates 77 are levered up when the handle 78 is depressed to move the legs upward. The pivotal movement of the handle 78 is limited by a limiting bar 88. When the handle 78 is released, the lifting plates 77 are moved back to the initial position due to the force of a leaf plate 89 which urges the stay bar 83 downward.

The lifting plates 77 contact the bottom surface of the flat bench 82 of the stage 76 at the top of the end portions 77*a*. The flat bench 82 is pivotally linked at the left and right side wall thereof with two pairs of arms 85 and 86, one pair on each side. Arms 85 and 86 are each pivotally mounted to respective side walls of the bracket 73. Therefore, the stage 76 is movable up and down along a circular orbit, while being supported and guided by this link mechanism, and is also movable horizontally together with the lower sliding plate 75.

Figure 7:
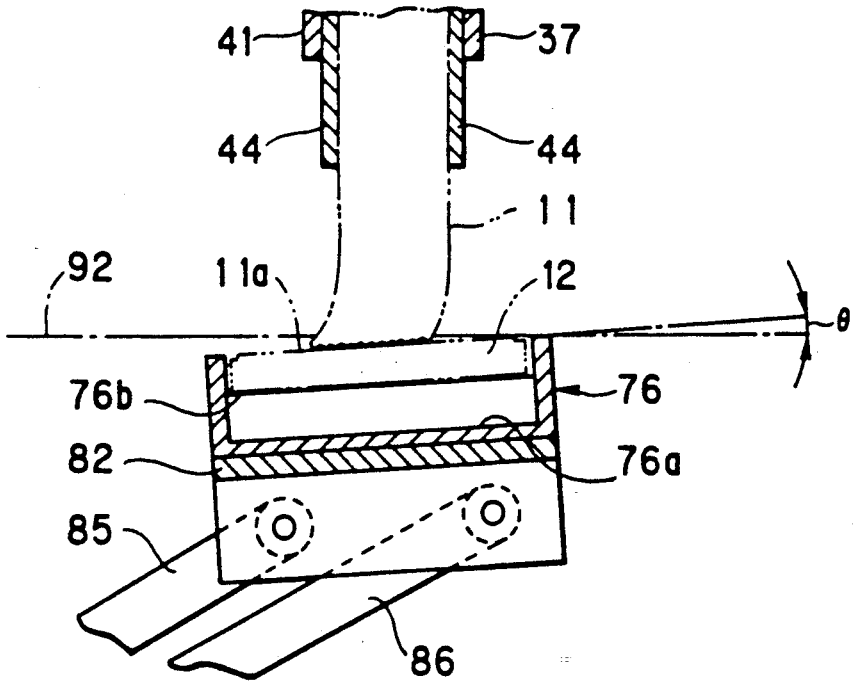
FIG. 7 is an enlarged sectional view showing a stage for supporting an adhesive tape, onto which a spine side of a booklet body is placed.

When the stage 76 is lifted by the lifting plate 77, the arms 85 and 86 rotate about the lower pivots thereof. Since the length between the upper pivot and the lower pivot of the arm 86 is slightly more than that of the arm 85, the stage 76 moves upward while being slightly inclined rearward with respect to a horizontal line 92, as shown in FIG. 7.

The stage 76 is provided with a plurality of ridges 76*b* extending parallel in the sliding direction and disposed at regular intervals. The ridges 76*b* serve to apply a concentrated large pressure to the adhesive tape 12 at the tip of each ridge 76*b*. The ridges 76*b* may be made of wire, or the like.

Now, the operation of the above-described photograph binding apparatus will be described.

In an initial position, the holding section 30 is opened as shown in FIG. 4, and the lower sliding plate 75 is in contact with the stopper 80. In the initial position, the adhesive tape 12 is put on the ridges 76*b* of the stage 76.

The adhesive tape 12 is surrounded by frames of the stage 76 on three sides.

Next, the booklet body 11 is inserted in the holding section 30, such that the spine side 11*a* of the booklet body 11 is carried on the photograph receiving tray 31 in a substantially horizontal fashion, while another side of the booklet body 11 is in contact with the positioning plate 72. Therefore, the booklet body 11 is supported at two sides. Thereafter when the lever 53 is pulled in the direction of the arrow A, the upper sliding plate 46 is slid forward against the force of the spring 68, due to engagement of the gear 50 with the rack 48. The ratchet mechanism 58 prevents the upper sliding plate 46 from moving backward.

When the upper sliding plate 46 is slid forward, the movable nipping member 38 moves toward the stationary nipping plate 37, thereby to nip the booklet body 11 between the nipping member 38 and the nipping plate 37 in a vertical fashion. The position of the pressing plate 41 is adjustable by means of the spring 42, in accordance with the thickness of the booklet body 11. Thereafter, the handle 78 is pushed to move the lower sliding plate 75 rearward, until the lower sliding plate 75 contacts against the stopper 81. Thereby, the photograph receiving tray 31 is retracted rearward from the spine side 11*a* of the booklet body 11, and instead, the stage 76 is placed below the booklet body 11.

Next, the handle 78 is depressed until it contacts against the limiting bar 88, so as to lift the stage 76 by way of the stay bar 83 and the lifting plates 77, along a circular orbit. Because the stage 76 is supported at either side by a pair of arms 85 and 86 of which the spacings between the upper and lower pivots are different from each other, the adhesive tape 12 laid on the stage 76 is lifted and pressed onto the spine side 11*a* of the booklet body 11 while being inclined with respect to the horizontal line 92, as shown in FIG. 7. As a result, the edges of the respective sheets of the booklet body 11 which contact the adhesive tape 12, are slightly curved. Accordingly, the adhesive of the layer 18 enters between the individual sheets or photographs. Therefore, every sheet is reliably adhered to the adhesive tape 12. Furthermore, the adhesive layer 18 is pressed onto the spine side 11*a* along the ridges 76*b*, with a concentrated large pressure.

The above mentioned inclination angle of the stage 76 with respect to the horizontal line 92 is preferably 5 to 30 degrees, and more preferably 10 to 20 degrees.

When the depression of the handle 78 is terminated, the stage 76 is moved downward due to the force of the leaf plate 89. Thereafter, the handle 78 is pulled up to be returned to the initial position. When the ratchet release lever 60 is pulled to release the ratchet mechanism 58, the upper sliding plate 46 is retracted rearward due to the force of the spring 68. Thereby, the nipping of the booklet body 11 is released, and the booklet body 11 attached with the adhesive tape 12 is removed from the holding section 30. Thereafter, the adhesive tape 12 stuck to the spine side 11*b* is folded along the edges of the front and rear cover sheets 13 and 14, and is stuck to the outside surfaces of the front and rear cover sheets 13 and 14. Finally, the tab portion 22 is cut off along the perforation line 25.

It is possible that a portion of the adhesive layer 18 which exceeds the spine side of the booklet body 11 may contact the rubber sheet 44, and the adhesive of the layer 18 may stick to the rubber sheet 44, while the booklet body 11 is being removed from the holding section 30. The adhesive stuck on the rubber sheet 44 may tend to undesirably adhere the rubber sheet 44 to the booklet body 11. In order to prevent this problem, the above-described rubber based adhesive is preferably used, because the rubber based adhesive can be easily wiped off the rubber sheet 44.

Figure 8:
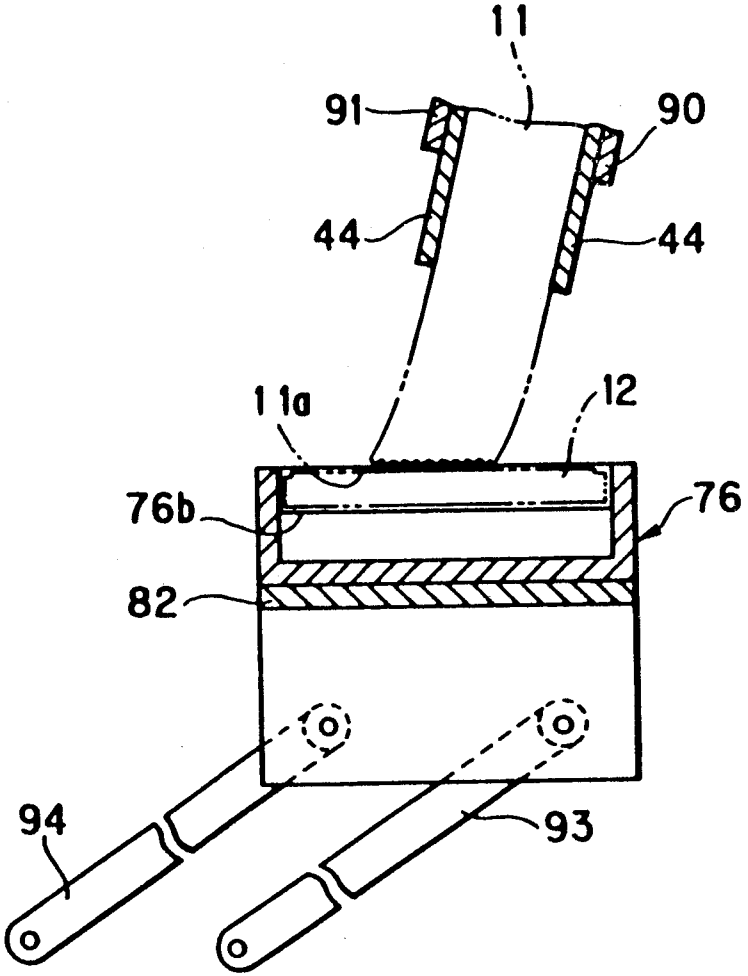
FIG. 8 and 8(A) is a photograph binding apparatus according to a third embodiment.
Figure 8A:
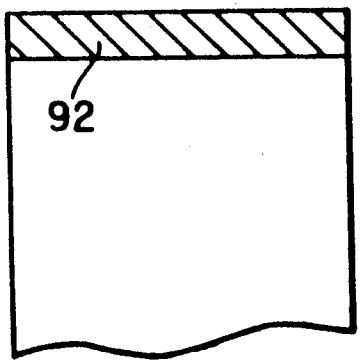

Although the holding section 30 is adapted to hold the booklet body 11 vertically, it is possible to lean the holding section itself. FIG. 8 shows a third embodiment having such a holding section, wherein a stationary nipping plate 90 and a movable nipping plate 91 lean forward with respect to the vertical plane. The booklet body 11 is inserted between these nipping plates 90 and 91, so that the spine side 11*b* is held horizontally. Rubber sheets are disposed on stationary nipping plate 90 and movable nipping plate 91.

After a photograph receiving tray 92 is retracted horizontally or vertically from the bottom of these nipping plates 90 and 91, a stage 76 is lifted along a circular orbit, while being supported horizontally by a pair of arms 94 and 95 of the same length. When the stage 76 is lifted sufficiently, the adhesive tape 12 on the stage 76 is pressed onto the spine side 11*a* of the booklet body 11. Because the booklet body 11 leans to slightly shift the lower ends of the sheets and photographs of the booklet body 11 away from one another on the spine side 11*a*, the adhesive of the layer enters between the individual sheets and photographs, even though the adhesive tape 12 is held horizontally when being pressed onto the spine side 11*a*. Therefore, the adhesive tape 12 is reliably adhered to the individual sheets and photographs of the booklet body 11.

The nipping plates 90 and 91 may lean backward. In this case, it is desirable to let the photograph receiving tray 92 down vertically or diagonally from the booklet body 11, so as the tray 92 will not rub against the grain of the sheets on the spine side 11*a*. Because the adhesive tape 12 is moved in a direction to strike directly against the spine side 11*a* of the booklet body 11, it is possible that the edges of the sheets of the booklet body 11 on the spine side 11*a* may tend to be bent upwards under the pressure of the stage 76. This can be prevented by extending the arms 94 and 95 so as to enlarge the radius of the circular orbit. Needless to say, this problem will not occur, if the arms 94 and 95 are pivoted clockwise.

Although the stage 76 is slidable horizontally together with the photograph receiving tray 31 in the above-described embodiments, it is possible to dispose the stage 76 below the holding section 30, so as to move the stage 76 vertically up and down after the photograph receiving tray 31 is retracted.

Figure 9:
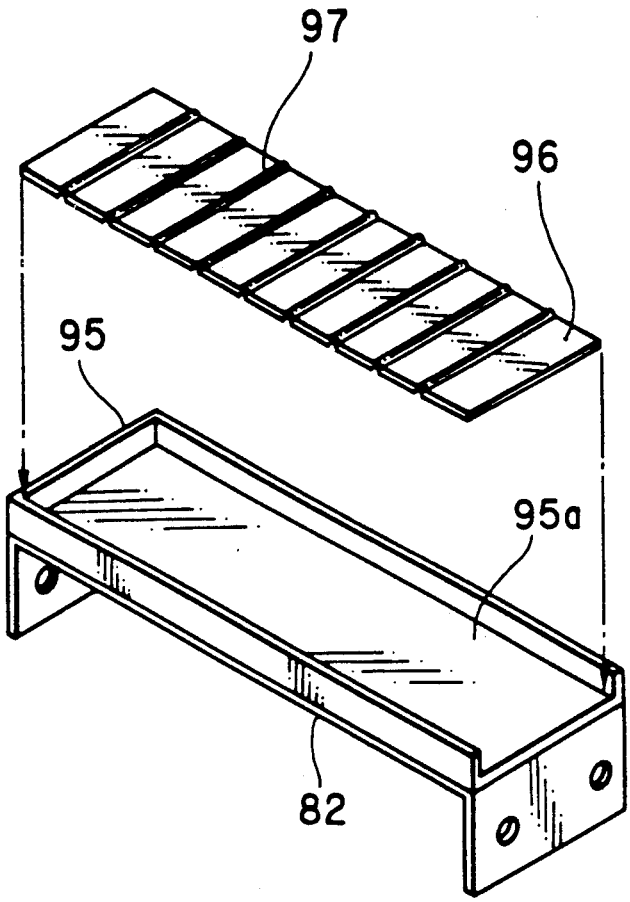
FIG. 9 is an exploded perspective view of a stage for supporting and pressing the adhesive tape according to a fourth embodiment.
Figure 10:
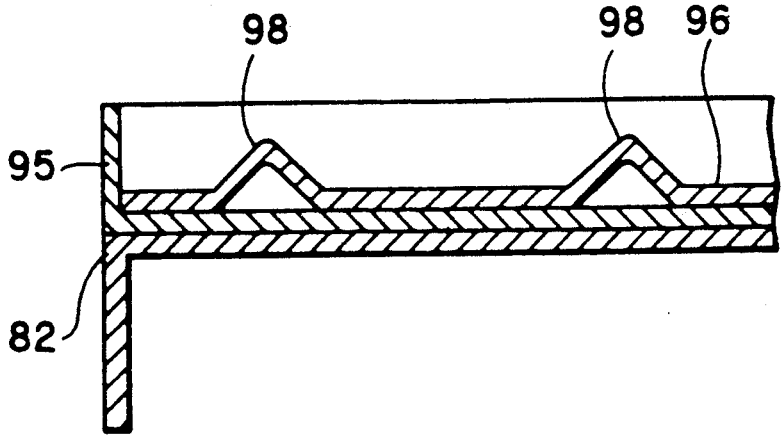
FIGS. 10 and 11 are sectional views showing variations of ridges of the stage of FIG. 9.
Figure 11:
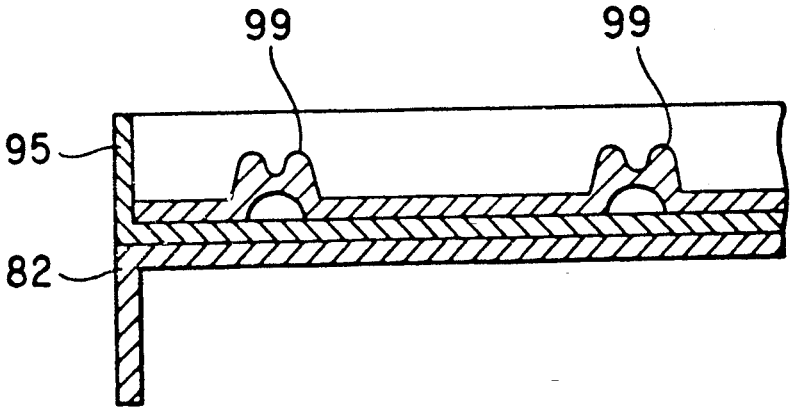

Although the ridges 76*b* are formed integrally with the stage 76, it is possible to cement a ridged plate 96 having many ridges 97 formed integrally therewith, onto a stage 95, as shown in the fourth embodiment illustrated in FIG. 9. The shape of the ridges 97 is semicircular in cross section, however, the ridges 97 may have any shape. For example, the ridged plate 96 may have triangular ridges 98 as shown in FIG. 10, or ridges 99 each having a plurality of peaks, as shown in FIG. 11. It is also possible to provide three steps of ridges arranged in a matrix. Also, wires or a mesh may be used instead of the ridges.

The booklet albums 10 are preferably made in photofinishing laboratories. In this case, it is desirable to make a large number of booklet albums 10 efficiently and automatically.

Figure 12:
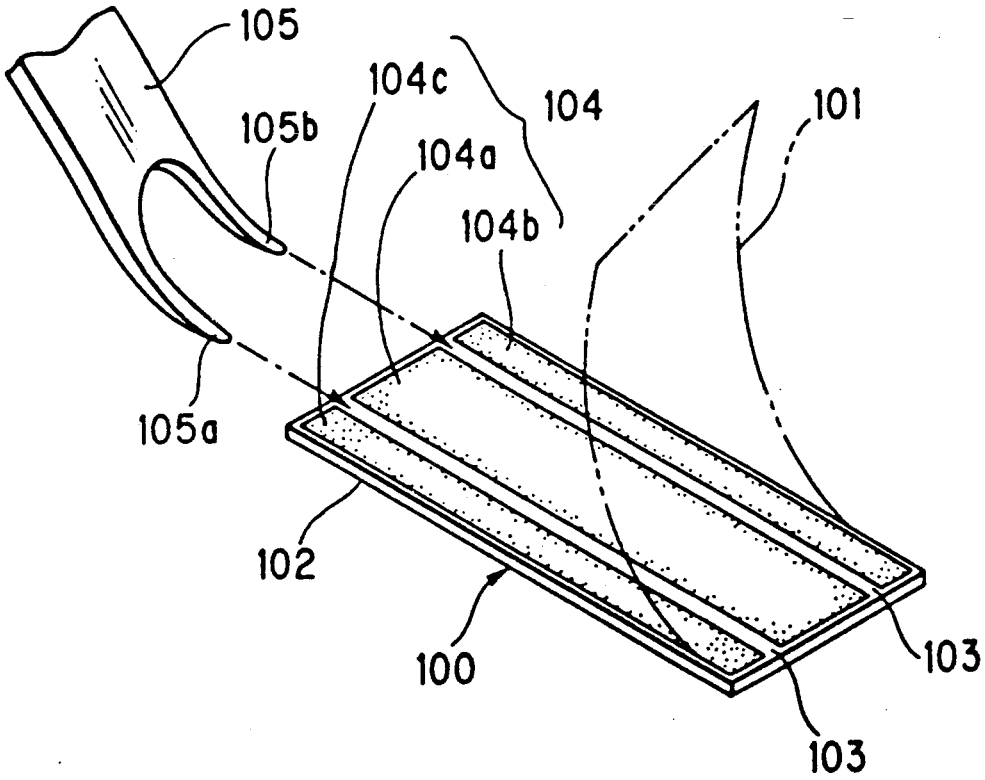
FIG. 12 illustrates a fifth embodiment of the invention.

FIG. 12 shows an adhesive tape 100 according to a fifth embodiment of the invention, of which a peelable paper 101 can be mechanically peeled off a base strip 102. For this purpose, a pair of non-adhesive tracks 103 extending parallel to each other in the lengthwise direction of the base strip 102 are provided in an adhesive layer 104. Namely, there are three adhesive layer segments 104*a*, 104*b* and 104*c* on the base strip 102.

The peelable paper 101 is peeled off the adhesive tape 100 by means of a separation member 105 provided in the automatic photograph binding apparatus. The separation member 105 has a pair of claws 105*a* and 105*b*, which correspond to the non-adhesive tracks 103. The claws 105*a* are slid along the non-adhesive tracks 103 to remove the peelable paper 101, as shown by arrows.

The front cover sheet 13 may be an index photograph in which a series of picture frames contained in an individual photographic film, that correspond to the photographs 15 filed in the booklet album 10, are printed in a reduced size and are arranged in a matrix. It is also possible to insert the index photograph between the memo paper 16 and the first photograph. The memo paper 16 may be replaced by the index photograph.

While the present invention has been described in detail above with reference to a preferred embodiment shown in the drawings, it will be apparent to those skilled in the art that various changes and modifications of the present invention are possible within the scope of the following claims.

What is claimed is:

1. A booklet album of a plurality of photographs comprising:

a booklet body consisting of a bundle of said photographs which are piled on one another, a front cover sheet and a rear cover sheet disposed on respective sides of said bundle to sandwich said bundle of photographs therebetween; and an adhesive tape stuck to each of said photographs, at one edge thereof, and to said front and rear cover sheets at one end thereof such that said adhesive tape forms a spine cover of said booklet body, wherein said adhesive tape comprises:

a base strip having an adhesive portion on which an adhesive layer is applied and a tab portion, said tab portion being bordered by a perforation line from said adhesive portion and being separated from said adhesive portion along said perforation line after sticking said adhesive tape to said booklet body; and a peelable paper removably stuck to said adhesive layer.

2. A booklet album of a plurality of photographs comprising:

a booklet body consisting of a bundle of said photographs which are piled on one another, a front cover sheet and a rear cover sheet disposed on respective sides of said bundle to sandwich said bundle of photographs therebetween; and an adhesive tape stuck to each of said photographs, at one edge thereof, and to said front and rear cover sheets at one end thereof such that said adhesive tape forms a spine cover of said booklet body, wherein said adhesive tape comprises:

a base strip on which an adhesive layer and at least a non-adhesive track are provided, said non-adhesive track extending in a longitudinal direction of said base strip and dividing said adhesive layer into sections; and a peelable paper removably stuck to said adhesive layer.

3. A booklet album as recited in claim 2, wherein said peelable paper is mechanically removed by sliding at least a claw on said non-adhesive track while inserting said claw between said peelable paper and said base strip.

4. A photograph binding apparatus for making a booklet album by binding a booklet body consisting of a bundle of a plurality of photographs, a front cover sheet and a rear cover sheet which are disposed on the front and rear side of said bundle respectively, an adhesive tape being adhered to the lower edges of said photographs and the lower ends of said front and rear cover sheets, said apparatus comprising:

nipping means for nipping said booklet body;

actuating means for displacing said nipping means between an opened state and a nipping state;

photograph receiving means for supporting lower ends of said photographs and said front and rear cover sheets which are inserted in said nipping means when said nipping means is set in said opened state;

transporting means for retracting said photograph receiving means from said lower ends after said nipping means has been moved to a nipping state so as to tightly nip together said photographs and said front and rear cover sheets; and pressing means for pressing said adhesive tape onto said lower ends by lifting a stage toward said lower ends after said photograph receiving means is retracted, said stage supporting said adhesive tape thereon.

5. A photograph binding apparatus as recited in claim 4, wherein said nipping means includes a stationary nipping plate and a movable nipping member which is moved by said actuating means in a first direction traversing said stage, so as to approach said stationary nipping plate.

6. A photograph binding apparatus as recited in claim 5, wherein said transporting means includes a first slider, to which said photograph receiving means is secured and on which said stage is movably mounted.

7. A photograph binding apparatus as recited in claim 6, wherein said first slider is moved in said first direction.

8. A photograph binding apparatus as recited in claim 7, wherein said pressing means includes a handle which operatively engaged with said stage and to said first slider, said stage being moved up and down in cooperation with said handle when said handle is operated.

9. A photograph binding apparatus as recited in claim 8, wherein said stage is slightly larger than said adhesive tape, and is slightly larger in width than a maximum thickness of said booklet body.

10. A photograph binding apparatus as recited in claim 9, wherein said movable nipping member comprises a pressing plate which is urged by springs toward said stationary plate and a fixed plate on which said springs are mounted, said fixed plate fixedly carried on a second slider.

11. A photograph binding apparatus as recited in claim 10, wherein said stationary nipping plate and said pressing plate are each provided with a rubber sheet on a surface thereof, said rubber sheets being in opposition to each other.

12. A photograph binding apparatus as recited in claim 11, wherein said actuating means includes a rack provided on said second slider, a gear mechanism which meshes with said rack, said rack and gear mechanism being actuated to move said second slider in said first direction to set said nipping means at said nipping state, and a ratchet mechanism coupled to said gear mechanism for preventing said movable nipping member from moving away from said stationary nipping plate.

13. A photograph binding apparatus as recited in claim 12, wherein said nipping means is set at said opened state due to the force of a spring when said ratchet mechanism is released.

14. A photograph binding apparatus as recited in claim 8, wherein said nipping means nips said photographs and said front and rear cover sheets in upright states, while said photograph receiving means holds said lower edges to align said photographs horizontally, and said pressing means presses said adhesive tape onto said lower ends while holding said adhesive tape in an inclined position in said first direction with respect to a horizontal line.

15. A photograph binding apparatus as recited in claim 8, wherein said nipping means nips together said photographs and said front and rear cover sheets in slightly inclined fashion in said first direction with respect to a vertical line, while said photograph receiving means holds said lower ends horizontally so as to shift said lower edges slightly away from one another, and said pressing means presses said adhesive tape in horizontal state onto said shifted lower edges.

16. A photograph binding apparatus as recited in claim 14 or 15, wherein said pressing means includes a link mechanism for supporting said stage, said link mechanism having at least two arms, one end of each of said arms being pivotally mounted to said stage, the other end of each said arms being pivotally mounted to a horizontally slidable plate, and a lifting mechanism for levering up said stage toward said lower ends.

17. A photograph binding apparatus as recited in claim 8, wherein said stage is provided with a plurality of projections on a surface thereof on which said adhesive tape is laid.

18. A photograph binding apparatus as recited in claim 17, wherein said projections are ridges extending in said first direction.

19. A photograph binding apparatus as claimed in claim 18, wherein said ridges are made of a plurality of wires.

20. A photograph binding apparatus as recited in claim 19, wherein said ridges are formed integrally with a ridge forming plate which is cemented to said surface of said stage.

21. A photograph binding apparatus as recited in claim 20, wherein each of said ridges are semicircular in section.

22. A photograph binding apparatus as recited in claim 21, wherein each of said ridges are triangular in section.

23. A photograph binding apparatus as recited in claim 22, wherein each of said ridges has two peaks.

* * * * *